US005112233A

United States Patent [19]

Lybrand

[11] Patent Number: 5,112,233

[45] Date of Patent: May 12, 1992

[54] ELECTRICAL CONNECTOR HAVING CONTACT RETENTION MEANS

[75] Inventor: Brent B. Lybrand, Spartanburg, S.C.

[73] Assignee: Thomas & Betts Corporation, Bridgewater, N.J.

[21] Appl. No.: 707,369

[22] Filed: May 30, 1991

[51] Int. Cl.[5] ..... H01R 13/41

[52] U.S. Cl. ..... 439/79; 439/733

[58] Field of Search ..... 439/733, 79, 869

[56] References Cited

U.S. PATENT DOCUMENTS

| | | | |
|---|---|---|---|
| 2,597,262 | 5/1952 | Roger | 439/733 |
| 3,493,916 | 2/1970 | Hansen | 439/79 |
| 3,533,054 | 10/1970 | Spriggs et al. | 439/733 |
| 3,551,877 | 12/1970 | Telmosse et al. | 439/597 |
| 4,186,988 | 2/1980 | Kobler | 439/676 |
| 4,210,376 | 7/1980 | Hughes et al. | 439/676 |
| 4,225,209 | 9/1980 | Hughes | 439/344 |
| 4,292,736 | 10/1981 | Hughes et al. | 29/884 |
| 4,491,376 | 1/1985 | Gladd et al. | 439/33 |
| 4,697,864 | 10/1987 | Hayes et al. | 439/444 |
| 4,744,771 | 5/1988 | Uchida | 439/733 |
| 4,789,346 | 12/1988 | Frantz | 439/80 |
| 4,842,528 | 6/1989 | Frantz | 439/80 |
| 5,037,334 | 8/1991 | Viselli et al. | 439/733 |

FOREIGN PATENT DOCUMENTS 6087177 6/1985 Japan .

*Primary Examiner*—Gary F. Paumen

*Attorney, Agent, or Firm*—Robert M. Rodrick; Salvatore J. Abbruzzese

[57] ABSTRACT

A right-angle electrical connector comprises an insulator supporting a plurality of electrical contacts therein. The insulator includes a locator plate having a plurality of open faced slots with parallel, straight sidewalls for retentive receipt of the contacts therein. Each contact has a mating portion that is received in an aperture in the insulator, a retention portion received in the insulator slots and a terminal portion serving as a solder post for subsequent soldering to circuits on a printed circuit board. Each retention portion is of solid cross-section and preferably comprises a trapezoidal cross-section with its non-parallel edges defining relatively sharp barbs. During insertion the barbs engage the respective sidewalls in interference fit, deforming the sidewalls in a manner to retain the contact therein and to resist movement thereof in both the horizontal and vertical directions.

16 Claims, 3 Drawing Sheets

ELECTRICAL CONNECTOR HAVING CONTACT RETENTION MEANS

FIELD OF THE INVENTION

The present invention relates to an electrical connector, and more particularly, to a contact alignment and retention system for right-angle electrical connectors.

BACKGROUND OF THE INVENTION

Right-angle, D-faced electrical connectors are used in the electronics industry as input/output (I/O) devices to interconnect a computer to external peripheral equipment. The contacts of the electrical connector are typically soldered to conductive traces on a printed circuit board at a backwall or panel of the computer. The front face of the connector, in addition to having the D-face for polarization, is mated with a complementary electrical connector which is attached to the peripheral equipment. The electrical contacts are supported in apertures in the insulative housing of the connector with the back ends of the contacts bent at right angles. Each contact terminates in solder posts which extend downward from the connector housing for insertion into through-plated holes in a printed circuit board (PCB) for subsequent soldering thereto. Maintaining the position and alignment of the projecting solder posts for ease of insertion into pre-formed plated through holes in a PCB has been recognized as a desirable feature of these connectors.

Various approaches have been developed to maintain the contact solder posts in a pre-determined, aligned position. For example, one commonly known technique is to form the connector housing to have a slotted locator plate wherein the slots are formed as straight parallel-walled channels which receive U-shaped, resilient retention portions of the contacts in frictional engagement. U.S. Pat. No. 3,493,916 (Hansen) exemplifies this technique.

U.S. Pat. No. 4,491,376 (Gladd, et al) illustrates another approach where the slots in the connector locator plate are formed to be narrower than the solder posts and which slots are configured to have recesses providing detents to retain the solder posts therein. Another slotted locator plate technique is shown in U.S. Pat. No. 4,789,346 (Frantz) wherein the locator plate slots are particularly configured to provide deflectable beams therebetween, the particularly configured slots receiving U-shaped portions of the contact therein. Still further, another approach addressing not only the maintenance of the contacts in a horizontal position but also in a vertical position is illustrated in U.S. Pat. No. 4,842,528 (Frantz) wherein the U-shaped retention portion of the solder posts are particularly configured to have stop shoulders to engage the top or bottom surfaces, or both such surfaces of the locator plate in an effort to prevent vertical movement of the contact in the connector.

Accordingly, it is desirable to provide an electrical connector wherein the terminal pins projecting therefrom for subsequent soldering to a printed circuit board are maintained in suitable alignment both horizontally and vertically and which also provides relative ease of assembly and effective costs of manufacture.

SUMMARY OF THE INVENTION

It is an object of the present invention to provide an improved electrical connector.

It is a further object of the present invention to provide an electrical connector having improved structure for retention and alignment therein of the solder post portion of the connector contact.

In accordance with the preferred form of the invention, an electrical connector comprises an insulator of insulative material including a body having a front face and a rear face with a plurality of contact receiving apertures extending therethrough. The body includes a locator plate having a plurality of slots each of which is defined by a pair of spaced, opposing sidewalls. Each slot opens adjacent the body rear face and extends toward the body front face. A plurality of electrical contacts are included, each contact having a mating portion, a retention portion and a terminal portion. Each mating portion is received in a respective body aperture. Each retention portion is received in interference fit in a locator plate slot. Each terminal portion projects outwardly from the locator plate. The contact retention portion of each contact has a solid cross-section and at least one barb having an exterior linear edge disposed obliquely relative to and in engagement with one of the slot sidewalls. Such exterior edge extends along the line converging with the sidewall in a direction toward the body rear face.

In accordance with another aspect of the invention, there is provided an electrical contact for use in an electrical connector. In a preferred arrangement, the contact comprises a generally elongate conductive member having a mating portion at one end thereof, a terminal portion at the opposite end thereof and a retention portion therebetween. The retention portion has a solid cross-section and has a generally flat outside surface and a pair of spaced exterior edges each of which intersects the outside surface obliquely. Each such edge defines a respective barb for retentive engagement of the contact in an electrical connector.

DETAILED DESCRIPTION OF THE PREFERRED EMBODIMENT

Figure 1:
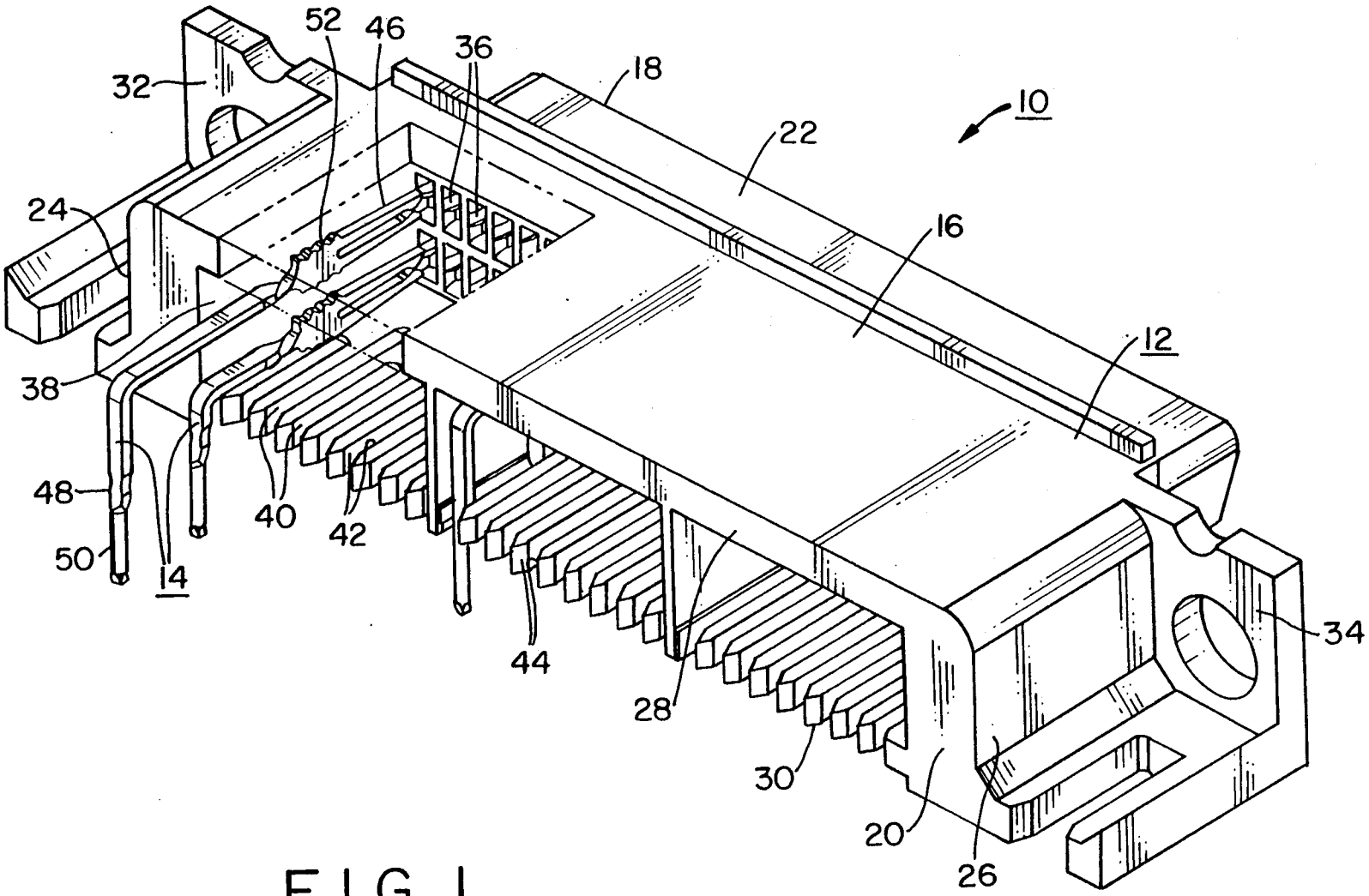
FIG. 1 is a rear perspective view of an electrical connector in accordance with a preferred form of the invention, partially broken away to reveal two contacts exploded from the connector.

Turning now to the drawing figures, there is shown in FIG. 1 a right-angle D-faced electrical connector 10 for mounting on a printed circuit board. Connector 10 basically comprises an insulator 12 and a plurality of right-angle electrical contacts 14. The connector 10 may comprise a conductive shell for protection against electro-magnetic or radio frequency interference (EMI/RFI) and hardware for attaching the connector to a complementary connector and for locking to a printed circuit board. Such shell and hardware are not shown in the drawings nor do they form any part of the instant invention.

The insulator 12 is formed of insulative material, preferably being a molded, one-piece, thermo-plastic material and comprises a generally elongate body 16. The body 16 includes a front face 18 and a rear face 20. The insulator body 16 comprises a front nose portion 22 configured in the conventional D-shape for polarized connection to a complementary connector, a pair of opposed, spaced endwalls 24 and 26, a top wall 28 and a bottom wall 30. Projecting outwardly from the respective endwalls 24 and 26 are mounting ears 32 and 34. Formed through the nose portion 22 are a plurality of apertures 36 which open through the front face 18 of the body 16. A cavity 38 opening at the rear face 20 of the body 16 extends between the endwalls 24, 26, the top wall 28 and the bottom wall 30, cavity 38 communicating with the apertures 36. Thus, apertures 36 are accessible for receipt of the contacts 14 therein through the cavity 38 opening at the rear face of the connector body 16.

The bottom wall 30 serves as a locator plate for the contacts, as will be described in detail hereinafter, and has therethrough a plurality of slots 40. Slots 40 open at the rear face 20 of the body 16, communicate with the cavity 38 and extend toward the body front face 18. Each slot 40, in the preferred arrangement, is defined by a pair of spaced, opposing, substantially parallel sidewalls 42. Each sidewall has in the preferred form, an inclined surface 44 which together define a wider opening of the slot a the rear face 20 to serve as an entrance guide for insertion of the contacts therein. The slots 40 may be formed to alternate between longer and shorter lengths extending toward the front face 18 of the body 16, as shown.

Still referring to FIG. 1, the electrical contacts basically comprise a mating portion 46 at one end of the contact, a retention portion extending at a right angle with respect to the mating portion 46, and a terminal portion 50 at the other end of the contact 14. The mating portion 46 of each contact is received in a respective body aperture 36 and may have serrated edges 52 to provide secured receipt in such apertures 36. The contact retention portions 48 of the contacts are received in the slots 40 in the locator plate 30, as will be described, at least two contacts being received in each slot 40. The terminal portion 50 of each contact projects downwardly from the locator plate 30 substantially perpendicularly thereto, each portion 50 serving as a solder post for subsequent soldering to plated-through openings in a printed circuit board.

Figure 2:
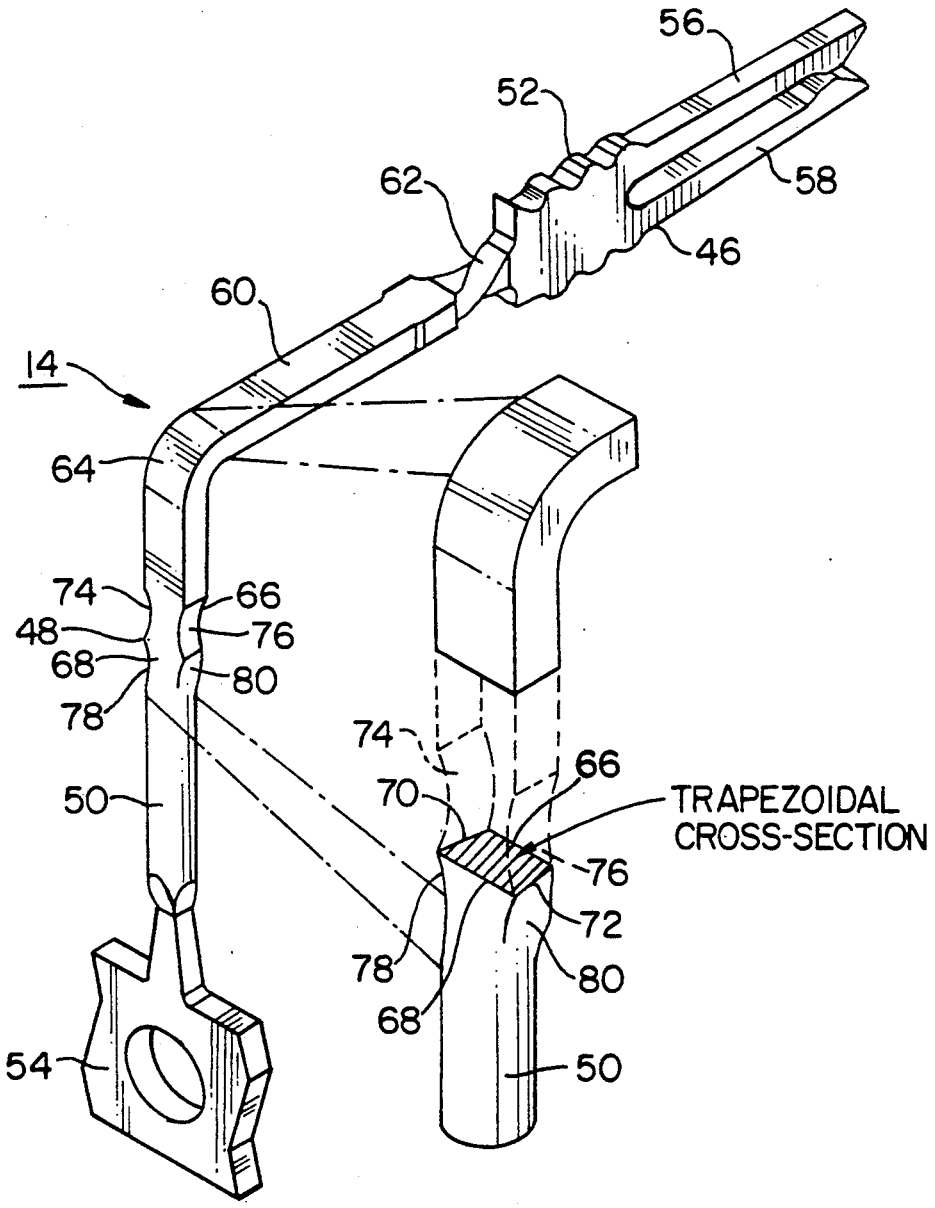
FIG. 2 is a perspective view showing an electrical contact of the subject invention in a stage of manufacture, with an enlarged portion showing details of the cross-section of the contact retention portion.

Turning now to FIG. 2, the details of the electrical contact 14 are more fully described. Contact 14 is comprised of a conductive metal, such as phosphor bronze. Preferably, for ease of manufacture, contact 14 is formed as a one-piece, integral member, stamped and formed from a sheet of such metal. As illustrated, contact 14 is of generally elongate structure and formed at a substantially right angle such that the terminal portion 50 extends generally perpendicular to the mating portion 46. As shown, the mating portion 50 during manufacture may be attached to a carrier strip 54 which is subsequently severed before the contact 14 is in use. The mating portion 46 is shown as a female socket comprising a pair of spaced tines 56, 58 but, may also be a male pin. Attached to the contact mating portion 46 is a shank 60 of solid, generally rectangular cross-section. The mating portion 46, in the preferred arrangement shown, is rotated 90 degrees with respect to shank 60 through a twisted neck portion 62. The shank 60 is bent at knee 64 to provide the right angle bend of the terminal portion 50 relative to the mating portion 46.

Extending downwardly from the shank 60 is the contact retention portion 48 which, in the preferred embodiment is formed of a solid cross-section of trapezoidal shape. At the contact retention portion 48, the contact comprises a pair of spaced, opposing, substantially parallel, flat outside surfaces 66 and 68. Non-parallel, linear exterior edges 70 and 72 intersect obliquely the flat surfaces 66 and 68 and together therewith form the trapezoidal cross-section. Edges 70 and 72 are formed to lie in respective directions that converge toward each other and that converge toward the flat surface 66 which faces contact mating portion 46.

Extending above the exterior edges 70 and 72 and communicating with the side edges of the shank 60 are a pair of spaced, curved recesses 74 and 76 extending into the contact at both sides thereof. Extending below exterior edges 70 and 72 and communicating with the contact terminal portion 50 are a pair of spaced, curved recesses 78 and 80 extending into the contact at both sides thereof. The contact terminal portion 50 is of solid cross-section and, in the preferred form, comprises a generally circular cross-section for enhanced stiffness for insertion into a printed circuit board. The curved surfaces of the upper recesses 74 and 76 merge with the curved surfaces of the lower recesses 78 and 80 to define the exterior linear edges 70 and 72, respectively. Edges 70 and 72 are each formed to be relatively sharp and serve as a barb to retain the contacts in the locator plate slots as will now be described by further reference to FIG. 3.

Figure 3:
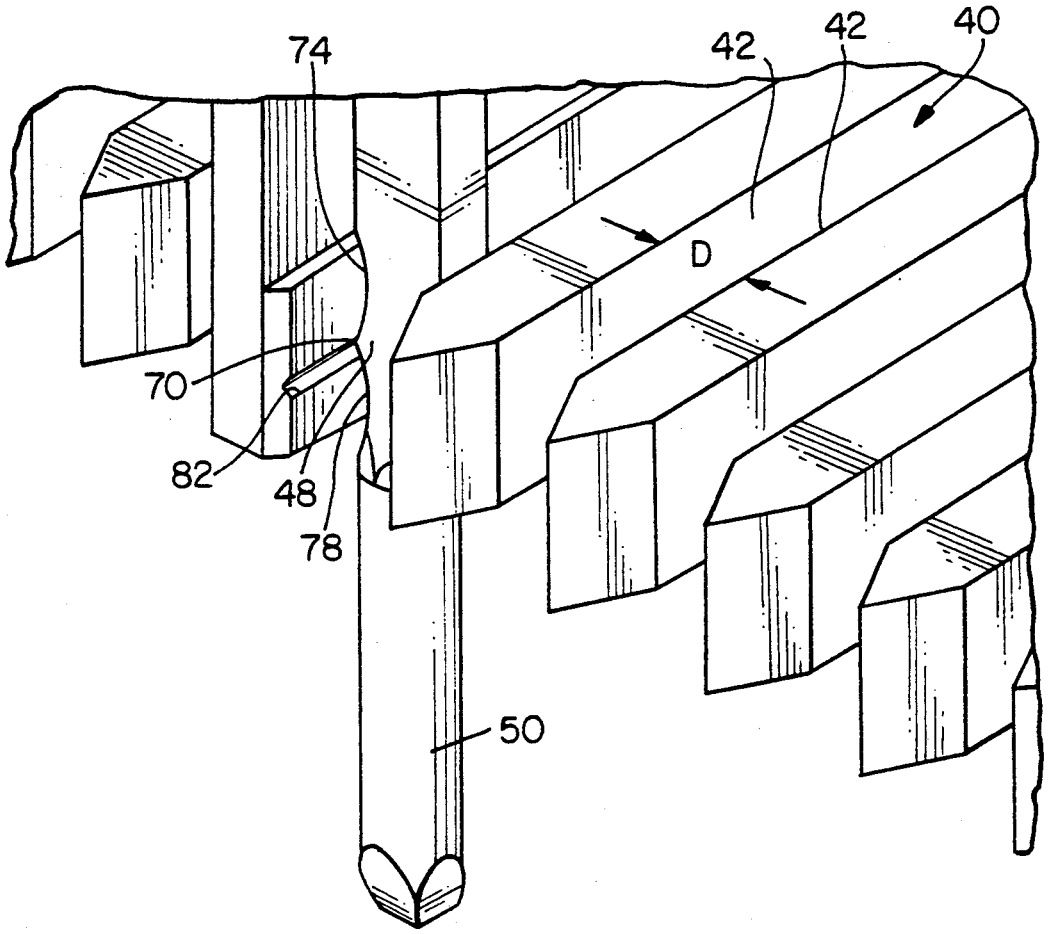
FIG. 3 is an enlarged view of a portion of the electrical connector of FIG. 1 showing details of the electrical contact as retained in a slot in the electrical connector.

The contact retention portion 48 at the location of the barbs 70 and 72 is formed such that the width of the outside surface 68 thereat is of greater dimension than the spacing, s, between the sidewalls 42 defining each slot 40. The width of the opposing outside surface 66 at the location of the barbs 70 and 72 is preferably formed to be of dimension less than the spacing, s, between the sidewalls 42 of a respective slot 40. Thus, upon assembly of the contacts 14 to the insulator 12, the contact mating portions 46 are inserted into the body apertures 36 and the contact retention portions 48 are slid into the locator plate slots 40. Flat surface 66, during insertion of the contacts 14 defines a leading edge of the contact while opposing flat surface 68 defines a trailing edge. During insertion, linear edges 70 and 72 of the barbs lie obliquely relative to the opposing sidewalls 42 such that each edge 70 and 72 converges with a respective sidewall in a direction toward the rear face of the insulator body. During insertion, the edges 70 and 72 of the barbs engage the sidewalls 42 adjacent the trailing edge 68 of the contact retention portion. Inasmuch as in the preferred form the width of leading edge 66 is less than the spacing, s, between the sidewalls, the edges 70 and 72 adjacent the leading edge 66 will not engage the sidewalls. As the cross-section of the contact retention portion 48 is solid, the edges 70 and 72 will scrape or deform the opposing sidewalls 42 causing an indentation 82, as illustrated in FIG. 3, in the respective sidewalls 42. As the curved surfaces of the recesses 74, 76, 78 and 80 are spaced from the respective sidewalls 42, a biting engagement of the barbs sharp edges 70 and 72 is achieved. Such a biting arrangement into the locator plate slots maintains the contact 14 in intimate retention with the slot sidewalls thereby providing resistance to horizontal motion in the X, Y plane, and to vertical motion in the Z plane. Also, as the slots 40 are formed in a relatively straight fashion without complicated, profiled recesses, manufacture is simplified. Furthermore, as the locator plate 30 is formed as an integral one-piece structure with the body 16, assembly of the contacts is simplified with the use of fewer parts.

Having described the preferred embodiment of the invention, it should now be appreciated that other variations may be made thereto without departing from the contemplated scope of the invention. For example, while the preferred cross-section of the contact retention portion has been described herein as being trapezoidal in cross-section, other solid cross-sections may be considered, such as triangular and polygonal, provided the linear edges defining the barbs converge toward each other in a direction of insertion toward the front face of the connector. As such, the preferred embodiment described herein is intended to be illustrative rather than limiting, the true scope of the invention being set forth in the claims appended hereto.

I claim:

1. An electrical connector, comprising:

an insulator of insulative material including a body having a front face and a rear face and a plurality of contact receiving apertures extending therethrough, said body including a locator plate having a plurality of slots, each slot being defined by a pair of spaced, opposing sidewalls and opening adjacent the body rear face and extending toward said body front face; and a plurality of electrical contacts each having a mating portion, a retention portion and a terminal portion, each mating portion being received in a respective body aperture, each retention portion being received in interference fit in a said locator plate slot, each terminal portion projecting outwardly from said locator plate, each said contact retention portion having a solid cross-section and at least one barb having an exterior linear edge disposed obliquely relative to and in engagement with one of said slot sidewalls, said exterior edge extending along a line converging with said sidewall in a direction extending between said body rear face and said front face.

2. An electrical connector according to claim 1, wherein each said contact retention portion comprises a pair of said barbs, said barbs being spaced generally opposite to each other.

3. An electrical connector according to claim 2, wherein said opposing sidewalls of each slot at the location of engagement with said barbs are substantially parallel.

4. An electrical connector according to claim 3, wherein the exterior edges of said opposing barbs lie in respective directions converging toward said front face of said connector.

5. An electrical connector according to claim 4, wherein said solid cross-section at said contact retention portion comprises a trapezoidal configuration, the converging edges of said barbs defining the non-parallel edges of said trapezoidal configuration, the shorter edge of said trapezoidal configuration being defined by a leading edge of said contact retention portion and the longer edge of said trapezoidal configuration being defined by a trailing edge of said contact retention portion.

6. An electrical connector according to claim 5, wherein said trailing edge of said contact retention portion is of dimension greater than the spacing between sidewalls of a respective slot.

7. An electrical connector according to claim 6, wherein said leading edge of said contact retention portion is of dimension less than the spacing between sidewalls of said respective slot.

8. An electrical connector according to claim 1, wherein each contact includes on one side of said barb a recess extending therein, said recess having a surface spaced from said sidewall and merging with said barb edge.

9. An electrical connector according to claim 8, further including a second recess in communication with said barb and extending into said contact, said second recess being disposed on the opposite side of said barb and merging with said recess to define said barb exterior edge.

10. An electrical contact for use in an electrical connector, comprising:

a generally elongate conductive member having a mating portion at one end thereof, a terminal portion at the opposite end thereof and a retention portion therebetween having a solid cross-section, said retention portion therebetween having a solid cross-section, said retention portion having a generally flat outside surface and a pair of spaced exterior edges, each intersecting said outside surface obliquely, and defining a respective barb for retentive engagement of said contact in an electrical connector, said exterior edges each lying in a direction converging towards the other, said retention portion further comprising an opposing, generally flat outside surface spaced from and being substantially parallel to said outside surface, the directions of said exterior edges diverging toward said opposing outside surface.

11. An electrical contact according to claim 10, wherein said exterior edges intersect said opposing outside surface, said exterior edges, said outside surface and said opposing outside surface defining said solid cross-section in a generally trapezoidal shape.

12. An electrical contact according to claim 11, wherein said contact includes between said mating portion and said retention portion a shank having a solid cross-section of generally rectangular shape.

13. An electrical contact according to claim 12, wherein said contact further includes a pair of recesses formed therein on opposite sides of said contact, each recess communicating with a respective barb and a side edge of said shank.

14. An electrical contact according to claim 13, wherein said contact further includes a second pair of recesses formed therein on opposite side of said contact, each recess of said second pair communicating with a respective barb and merging with said pair of recesses to define said respective exterior edges of said barbs.

15. An electrical contact according to claim 14, wherein said terminal portion comprises a solid cross-section of generally circular shape.

16. An electrical contact according to claim 15, wherein said contact is integrally formed of one-piece stamped and formed metal.

* * * * *